US006640593B1

(12) United States Patent
Hannah et al.

(10) Patent No.: US 6,640,593 B1
(45) Date of Patent: Nov. 4, 2003

(54) ADAPTOR FOR A DOOR LOCKING MECHANISM

(75) Inventors: Bruce Hannah, New York, NY (US); Tanya Vancott, New York, NY (US)

(73) Assignee: The Ironmonger, Inc., Chicago, IL (US)

( * ) Notice: Subject to any disclaimer, the term of this patent is extended or adjusted under 35 U.S.C. 154(b) by 0 days.

(21) Appl. No.: 10/114,827

(22) Filed: Apr. 2, 2002

(51) Int. Cl.[7] ..... E05B 13/10
(52) U.S. Cl. ..... 70/224; 282/336.3; 282/350
(58) Field of Search ..... 70/207, 210, 215–217, 70/221–224, 466; 292/336.3, 347, 348, 350, 356, DIG. 53, DIG. 64

(56) References Cited

U.S. PATENT DOCUMENTS 4,435,967 A * 3/1984 Best et al. ..... 70/224
4,655,059 A * 4/1987 Best et al. ..... 70/224
4,709,565 A * 12/1987 Lin ..... 70/107
4,835,998 A * 6/1989 Steinbach ..... 70/208
4,876,783 A * 10/1989 Campion et al. ..... 70/224 X
5,077,994 A * 1/1992 Trull et al. ..... 70/224
5,481,890 A * 1/1996 Millman ..... 70/224
5,921,119 A * 7/1999 Myers et al. ..... 70/208
6,029,484 A * 2/2000 Jetton ..... 70/371
6,412,319 B1 * 7/2002 Adelmeyer et al. ..... 70/224
6,422,049 B1 * 7/2002 Jenks ..... 70/208

* cited by examiner

*Primary Examiner*—Lloyd A. Gall

(57) ABSTRACT

The invention relates to a novel locking assembly including a readily removable handle arrangement that can be quickly and easily interchanged with any number of other handles having whatever configuration is desired. This is accomplished by introducing an adaptor between the conventional locking mechanism and the handle that facilitates the rapid interchange. Specifically, the adaptor includes the key core and defines an outer end surface having a raised portion of an elliptical shape and a corresponding handle that has an end opening that conforms to the elliptical shape and when in place is secured to the adaptor.

2 Claims, 1 Drawing Sheet

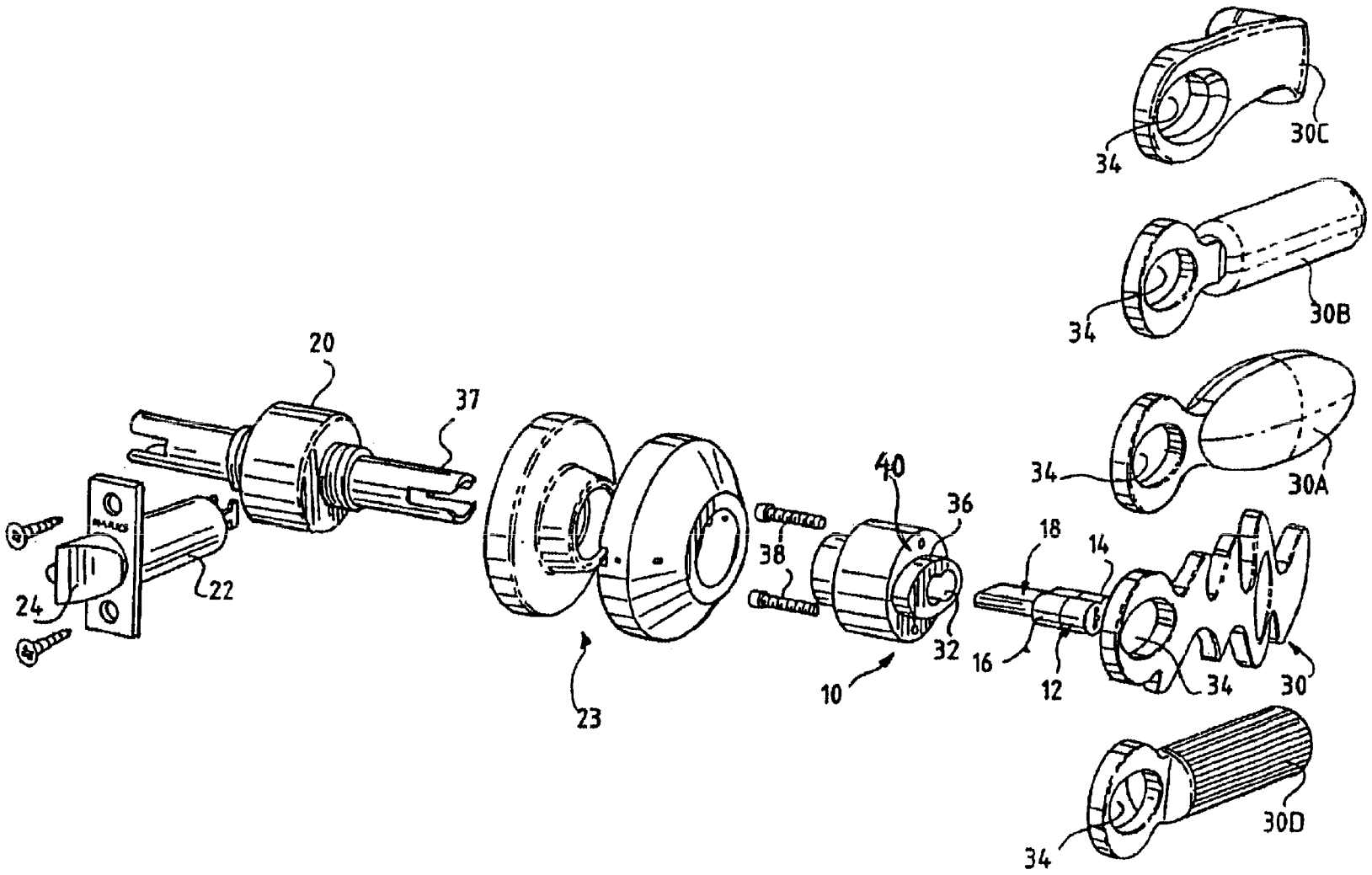
30C
30B
30A
30
30D
34
34
34
34
34
14
12
18
16
36
32
40
10
38
23
37
20
22
24

ADAPTOR FOR A DOOR LOCKING MECHANISM

BACKGROUND OF THE INVENTION

The present invention relates to cylindrical locks. Currently there are many lever operated cylindrical locksets in the market place. These essentially include a lever handle that is cast and fitted onto the locking mechanism. The potential for a manufacturer to add new designs to their range, or to offer custom designs for small production quantities, without requiring expensive tooling each time has been a long felt need in the industry.

There are on the market conversion kits for changing knob-handled cylindrical locksets, or for changing knob handles between different manufactures locksets, as typified by those shown in U.S. Pat. Nos. 4,876,783 and 5,481,890 but they require the replacement of many parts, and are limited to the specific change made.

It can be appreciated that if the industry is provided with a system whereby the handles can be readily and economically changed without effecting existing cylindrical lock mechanisms and associated latch means, the lock manufacturer and user will have the ability to introduce a wide variety of lock handles with pin tumbler assemblies. Furthermore if the lock assembly is designed so that the only critical feature of the handle is that it be manufactured with an opening at its end that will fit a correspondingly shaped portion of the lock adaptor assembly the handle can be formed into whatever shape desired thus giving the lock manufacturer and user the ability to truly have "decorator" handles of whatever size and shape desired along with whatever information or logo they desire to place thereon.

SUMMARY OF THE INVENTION

In accordance with the present invention there is provided a novel adaptor assembly that will fit between the cylindrical lock mechanism and the handle. The adaptor assembly provides for conventional keyed cylinders of all types to be inserted prior to assembly of the handle and final installation onto the lockset mechanism. The outer face of the adaptor has a raised oval step to which the handle is fixed and secured to the adaptor with bolts from the side opposite the raised oval step. Any of a wide variety of handles can be employed which handles can be cut into whatever shape desired so long as there is an oval opening at one end that fits over the oval step of the adaptor and is secured relative thereto. However, while an oval step and opening has been described the invention is not limited to this configuration. It is only necessary that the step portion and opening have mating configurations. The adaptor assembly allows for any standard type of pin tumbler including interchangeable cores to be incorporated into the lockset. The adaptor can be applied to existing cylindrical lock mechanisms. The adaptor includes an oval shaped portion that receives any handle that defines an opening having the same shape and this permits the adaptor to accommodate any shaped handle having a corresponding opening with the obvious advantage that the handle can be readily changed, a feature which makes for ready acceptance in the industry.

Other features of applicants novel invention will be seen from the accompanying drawing in which the FIG. 1 shows an exploded view of one half of a door locking assembly along with the examples of various types of handles that can be used. The variety of handles is essentially limitless and those shown are only intended to be representative.

DESCRIPTION OF DRAWING

The drawing FIGURE is an exploded perspective view. The novel adapter 10 for the locking assembly is secured relative thereto and comprises a cylinder core that includes a core body 12 having a lower lobe 14 and upper lobe 16. A conventional key plug is mounted in the upper lobe 16 which is formed to include a keyway for accepting an operating key. A conventional throw member 18 interconnects the tail end of the lock core 12 with the conventional cylindrical lock mechanism 20 that generates a bolt retractor mechanism 22 that is conventional and is mounted inside a door (not shown) in a conventional way. Also shown is a conventional rose and base assembly 23 to cover the door opening. The lock core 12 can be operated using an operating key to rotate the throw member 18 about the longitudinal axis to either lock or unlock the bolt 24 connected to the retractor mechanism 22. When unlocked the retractor mechanism can be activated by rotating the door handle 30 described in detail hereinafter about its axis of rotation to retract the latch bolt 24 mounted in an edge face of a door.

The lock core 12 extends through the opening 32 corresponding thereto in the adaptor 10 with the throw member 18 adapted to extend into the outside lock tube 37 that is connected to the cylindrical lock mechanism 20 that includes a retractor (not shown) that operates the bolt 24 located in the retractor mechanism 22.

The adapter 10 includes on its outer face a raised oval shaped portion 36 that defines the opening 32 into which the key core 12 fits flush with respect to the outer surface of oval shaped portion 36. By providing the raised oval shaped portion 36 any of a wide variety of handles that defines at its end portion an elliptical opening 34 that conforms to the oval shaped portion 36 can be used. Thus any number of decorative handles such as 30, 30*a*, 30*b*, 30*c* and 30*d* shown in the right hand portion of the drawing can be employed.

It is noted that all of the handles 30 etc. have one feature in common and that is they each have an elliptical opening 34 that is designed to fit over the raised oval shape portion 36 of the adaptor. These handles 30 can be readily cut from any appropriate metal desired or formed in an otherwise equivalent manner. The handles 30 are connected to the adaptor assembly by fasteners 38 that extend through the end of the adaptor opposite to the raised oval face 36 the fasteners extending through a planar portion 40, from which projects the oval portion 36.

It can be appreciated that there is provided a new and novel lock assembly wherein the handles can be readily changed by removal of the novel adaptor from the lock assembly, unscrewing the fasteners securing the handle to the adaptor, replacing the handle and reconnecting the handle to the adaptor.

While an oval shaped raised portion and a corresponding oval handle opening is illustrated and described. The invention is not limited to this design. The only criteria is that the handle opening and raised portion of the adapter have the same configuration so one can accommodate the other.

It is intended by the following claims to cover all those embodiments that fall within the spirit and scope of the invention.

What is claimed is:

1. A removable handle assembly for a door locking assembly that includes a locking mechanism that when operated retracts a door latch, a rose and base assembly fitting over an opening in the door, an adaptor fitting within an opening defined by the rose and base assembly, the adaptor containing a cylinder core and a throw member that extends from the cylinder core through aligned openings in the rose and base assembly that interconnects the cylinder core with the locking mechanism, the outer portion of the adaptor defining a planar portion and a raised portion having an oval configuration, a handle defining an opening extending therethrough having the same configuration as said raised portion and defining a surface disposed against said planar portion, and at least one fastener extending through the planar portion and being received by the handle when the handle is in position with its opening receiving the raised portion of said adaptor with the planar portion of the adaptor in abutting relationship with said handle surface whereby the handle can be interchanged and maintained in positive engagement with said adaptor whenever desired by merely disengaging the handle from the adaptor and replacing it with a different handle that defines an opening corresponding to the raised portion of said adaptor.

2. A removable handle assembly as set forth in claim 1 which the locking mechanism is cylindrical and the aligned openings in said rose and base member are round to receive a cylindrical inner end of said adaptor and the handle is secured to said adaptor by fasteners extending through aligned openings in said adaptor and handle.

* * * * *